US006050708A

United States Patent [19]

Roorda

[11] Patent Number: 6,050,708

[45] Date of Patent: Apr. 18, 2000

[54] UNDER CABINET LIGHT FIXTURE ADAPTED FOR CONNECTION TO WIRE RACEWAY

[75] Inventor: John W. Roorda, La Jolla, Calif.

[73] Assignee: Westek Associates, San Diego, Calif.

[21] Appl. No.: 08/773,984

[22] Filed: Dec. 26, 1996

[51] Int. Cl.[7] ..... F21V 21/00

[52] U.S. Cl. ..... 362/375; 362/147; 362/801; 362/133

[58] Field of Search ..... 362/226, 374, 362/375, 801, 133, 147, 249, 362; 439/209, 210, 213, 216; 174/48; 52/220

[56] References Cited

U.S. PATENT DOCUMENTS 3,061,716 10/1962 Benander ..... 362/226
3,836,766 9/1974 Auerbach ..... 362/374
4,298,919 11/1981 Karasawa ..... 362/391
4,358,635 11/1982 Druffel ..... 362/147
5,063,486 11/1991 Cummings, III et al. ..... 362/217

*Primary Examiner*—Thomas M. Sember
*Attorney, Agent, or Firm*—Brown Martin Haller & McClain LLP

[57] ABSTRACT

A light fixture comprising a metal housing and at least one lamp assembly mounted inside the housing. The housing, includes a metal backing plate and a metal cover secured to the backing plate. The lamp assembly is mounted in an interior of the housing providing light through an aperture in the metal cover. The backing plate is formed with at least one projecting tongue that can be inserted between the base and cover section of a metal raceway. Electrical conductors may be pulled through the raceway for connection to the lamp assembly.

9 Claims, 3 Drawing Sheets

UNDER CABINET LIGHT FIXTURE ADAPTED FOR CONNECTION TO WIRE RACEWAY

BACKGROUND OF THE INVENTION

The present invention relates generally to light fixtures, and more particularly, to an under cabinet halogen light fixture configured in the form of a relatively thin narrow bar adapted to be mounted on a downwardly facing surface of a cabinet and having a metal backing place configured for mating connection with a metal raceway enclosing electrical conductors.

In recent years, low wattage accent lighting has become popular in home decorating. In one form of this accent lighting, strings of low voltage incandescent lights have been mounted beneath kitchen cabinets. More recently, low profile light fixtures incorporating small halogen lamps have become popular. These light fixtures typically include a stamped metal backing plate which is secured with screws to the underside of the cabinet and a removable stamped metal cover which encloses one or more halogen lamp assemblies, a transformer, lenses and a switch. See for example U.S. Pat. No. 5,426,572 granted Jun. 20, 1995 to Steven P. Weinstock, et al.

In many jurisdictions the local government mandates that electrical installations meet certain codes, such as the National Electrical Code (NEC). Such codes frequently require that surface mounted wiring typically installed long after construction be enclosed in protective outer conduits or raceways.

The present invention is directed to solving the problem of rapidly and safely connecting an under cabinet light fixture to a source of electrical power provided to the fixture through a metal raceway.

SUMMARY OF THE INVENTION

In accordance with my invention, a light fixture comprises a metal housing and at least one lamp assembly mounted inside the housing. The housing includes a metal backing plate and a metal cover secured to the backing plate. The lamp assembly is mounted in an interior of the housing for providing light through an aperture in the metal cover. The backing plate is formed with at least one projecting tongue that can be inserted between the base and cover section of a metal raceway. Electrical conductors may be pulled through the raceway for connection to the lamp assembly.

DETAILED DESCRIPTION OF THE PREFERRED EMBODIMENT

Figure 1:
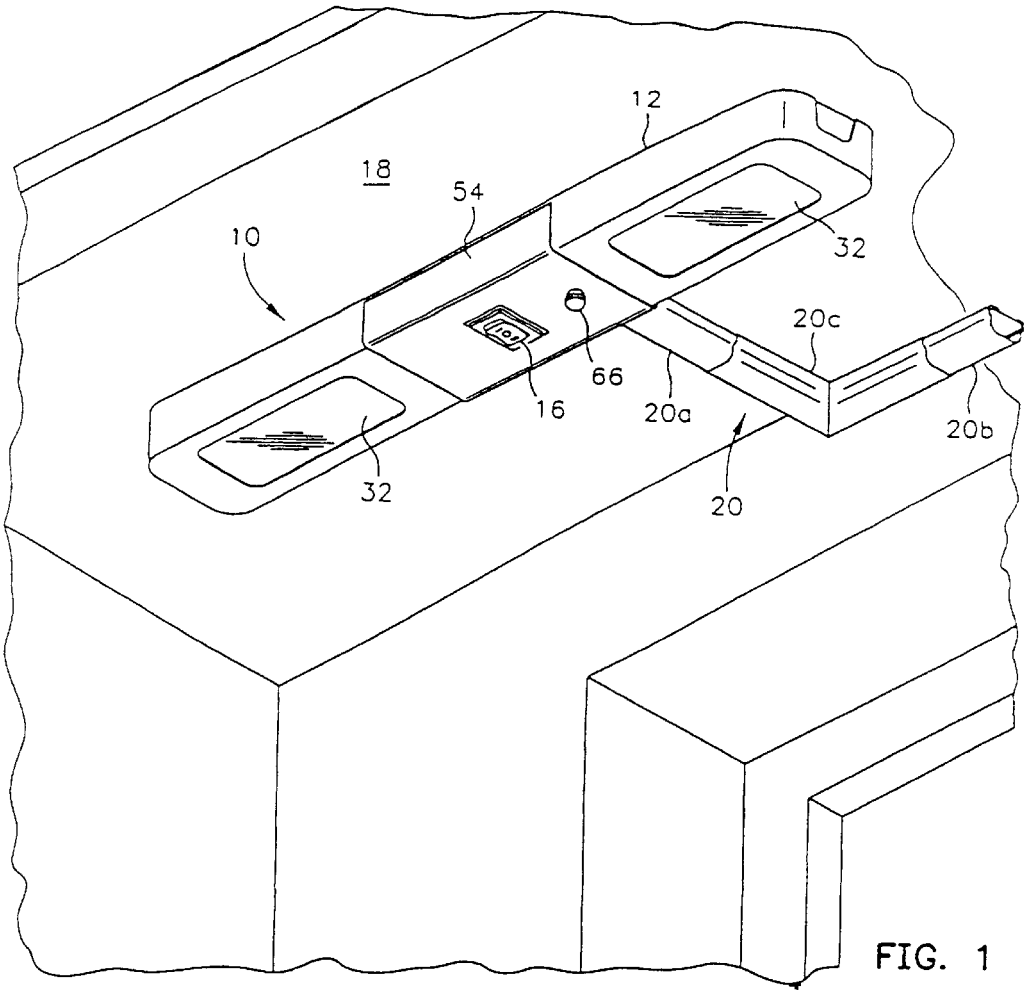
FIG. 1 is a perspective view of a low profile light fixture mounted to the underside of a cabinet next to a window. The light fixture is connected to a L-shaped metal raceway in accordance with a preferred embodiment of the present invention.
Figure 2:
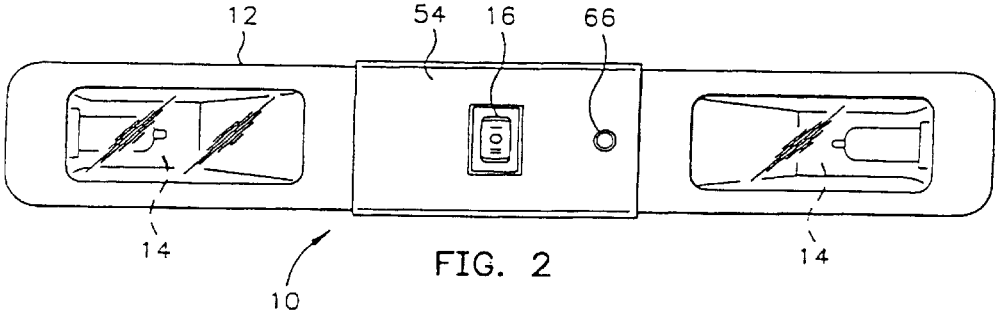
FIG. 2 is an enlarged top plan view of the light fixture of FIG. 1.

In accordance with my invention a light fixture 10 comprises a generally rectangular metal housing 12 (FIG. 1), a pair of halogen lamp assemblies 14 (FIG. 2) mounted inside the housing and a manually actuable rocker switch 16 (FIG. 2) mounted to the housing 12 for controlling the energization of the lamp assemblies 14. The housing 12 (FIG. 1) has an elongated, thin low profile shape so that it will not be visible when mounted to the underside of a wooden kitchen cabinet 18. The lamp assemblies 14 point downwardly and thus provide accent illumination on the countertop (not illustrated) below the cabinet 18.

An L-shaped metal raceway 20 (FIG. 1) is connected to the housing 12. It encloses electrical conductors such as ROMEX™ wire for connecting the lamp assemblies 14 to the household electricity. The metal raceway 20 includes a first straight segment 20*a* (FIGS. 1 and 4) extending rearwardly from the light fixture housing 12 under the cabinet 18. The metal raceway 20 further includes a second straight segment 20*b* extending laterally under the cabinet 18. A right angle portion 20*c* of the metal raceway 20 connects the first and second segments 20*a* and 20*b*.

The metal raceway 20 (FIG. 1) is preferably assembled from components that are commercially available under the trademark WIREMOLD from The Wiremold Company, Electrical Division, 60 Woodlawn Street, West Hartford, Conn.

The housing 12 (FIG. 1) is made of stamped sheet metal and includes a metal backing plate 22 (FIGS. 3 and 4) and a metal cover 24 (FIG. 3) removably secured to the backing plate 22. Screws (not illustrated) extend through key holes 26 (FIG. 4) in the backing plate 22 for securing the light fixture 10 to the underside of the cabinet 18.

The halogen lamp assemblies 14 (FIG. 2) are mounted in an interior of the housing 12 for providing light through apertures 28 in the metal cover 24. The metal backing plate 22 is formed with four mounting pads or protrusions 30 (Fig,. 4) which contact the underside of the cabinet 18. Clear or frosted diffusing lenses 32 (FIG. 3) are releasably held in position over the apertures 28 by spring-action metal clips 34.

Figure 3:
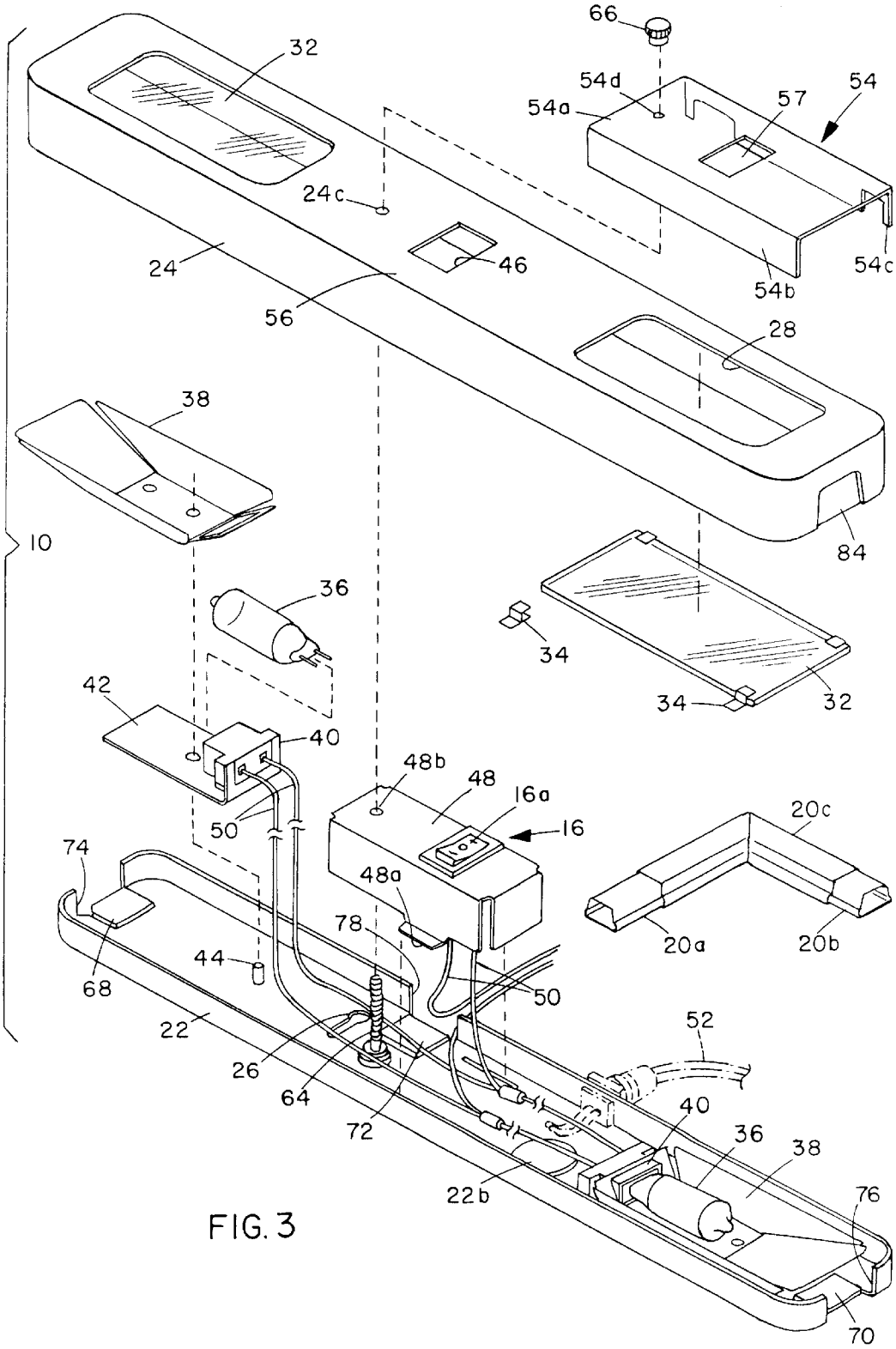
FIG. 3 is an enlarged exploded perspective view of the light fixture and metal raceway of FIG. 1.
Figure 4:
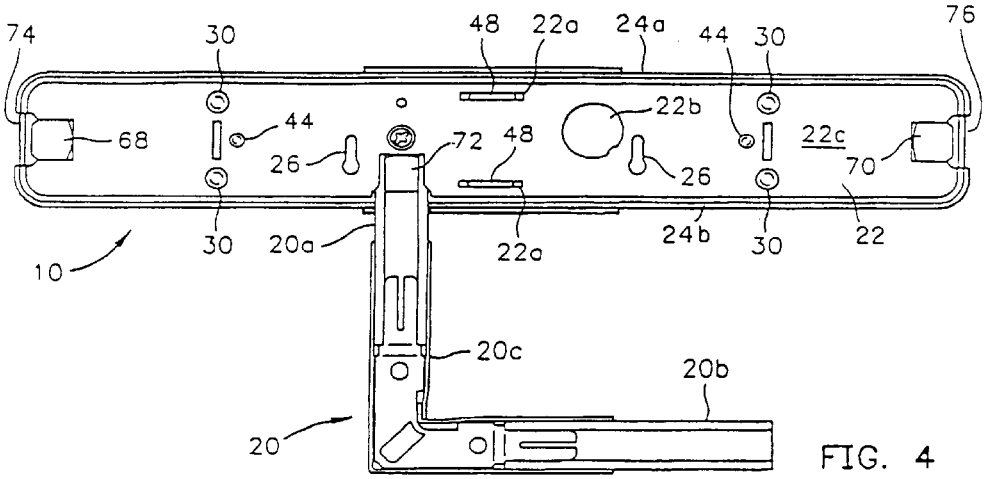
FIG. 4 is an enlarged bottom plan view of the light fixture and metal raceway of FIG. 1.

The two lamp assemblies 14 (FIG. 2) include corresponding halogen bulbs 36 (FIG. 3) that are preferably designed with special filaments that permit them to operate on one hundred and twenty volt AC line power, without the necessity of utilizing a transformer. The bulbs 36 radiate a significant amount of heat that is absorbed by the metal cover 24 (FIG. 3). The lamp assemblies 14 also include folded metal reflectors 38 (FIG. 3) which are secured to the metal backing plate 22 and plastic support sockets 40 for the bulbs 36. The sockets 40 are supported in recesses in L-shaped metal brackets 42. The reflectors 38 and L-shaped brackets 42 are secured to the metal backing plate 22 by rivets 44 (FIGS. 3 and 4).

The manually actuable switch 16 (FIGS. 1 and 3) is mounted in an aperture 46 (FIG. 3) in the metal cover 24. The switch 16 is connected to the halogen bulbs 36 of the lamp assemblies 14 for controlling the energization thereof. Preferably the switch 16 has a three-position rocker arm 16*a* (FIG. 3) that may be used to manually select OFF and two levels of brightness. The switch 16 incorporates a diode (not illustrated) which is switched in and out of the power circuit to divide the AC power delivered to the bulbs 36 in half, thereby achieving an inexpensive and reliable dimmer control. The body of the switch 16 is mounted in a rectangular recess in a box-shaped metal bracket 48. The feet 48*a* of the metal bracket 48 snap into slots 22*a* (FIG. 4.) in the backing plate 22. The backing plate 22 also has a pre-punched circular tab 22*b* (FIG. 4) which may be knocked out to allow ingress and egress of ROMEX™ or other AC wiring in lieu of the connection of AC power through conductors pulled through the metal raceway 20.

The wiring inside the light fixture 10 includes wires 50 interconnecting a conventional AC power cord 52 with the lamp sockets 40 and the switch 16. A ground wire (not illustrated) may also be provided for connecting a ground lead (not illustrated) of the power cord 52 to the metal backing plate 22. Instead of the contentional AC power cord 52, the preferred embodiment connects the internal wires 50 of the light fixture 10 to the black and white wire of a ROMEX wire pulled through the metal raceway 20. The raceway 20 is not used when the conventional AC power cord 52 is utilized.

A heat shield 54 (FIG. 1) is located in an operative position overlying a control surface region 56 (FIG. 3) of the metal cover 24 surrounding the switch aperture 46. The heat shield 54 is sized and configured so that a user's fingers will not directly contact the warm control surface region 56 of the metal cover 24 when the switch 16 is actuated. The heat shield 54 reduces the amount of heat otherwise felt by the user when manually actuating the switch 16. It is preferably made of a high temperature resistant plastic such as that sold under the trademark LEXAN that will not degrade or deform as a result of long term exposure to the heat generated by the adjacent halogen bulbs 36.

Figure 5:
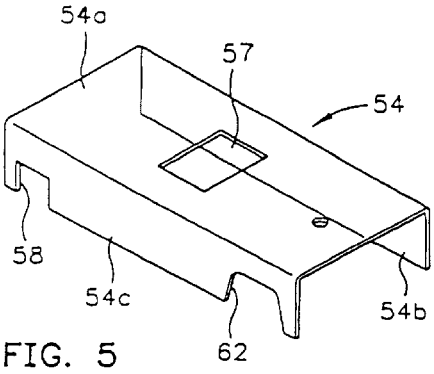
FIG. 5 is a greatly enlarged perspective view of the heat shield of the light fixture of FIG. 1.
Figure 6:
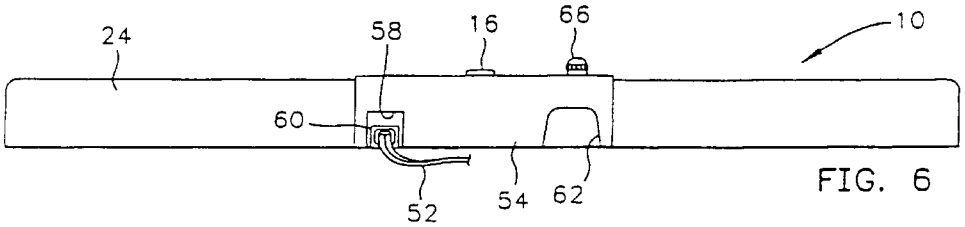
FIG. 6 is a side elevation view of the light fixture of FIG. 1.

The heat shield 54 has a main rectangular planar section 54*a* which overlies the control surface region 56 when the heat shield is in its operative position. The heat shield 54 further has a pair of minor rectangular planar sections 54*b* and 54*c* which extend perpendicularly from a pair of opposite side edges of the main planar section 54*a*. The minor planar sections 54*b* and 54*c* overly a pair of opposite side walls 24*a* and 24*b* (FIG. 4) of the metal cover 24 when the heat shield 54 is in its operative position shown in FIG. 1. Thus the minor planar sections 54*b* and 54*c* serve to properly locate the heat shield 54 so that a switch aperture 57 (FIG. 5) in the heat shield 54 is aligned with the switch aperture 46 (FIG. 3) in the metal cover 24. This allows the rocker arm 16*a* of the switch 16 to extend through the heat shield 54 and be toggled by the user's finger tips. The heat shield 54 has a notch 58 (FIG. 5) aligned with an aperture 60 (FIG. 6) in a side wall of the metal cover 24 in which the terminal end of the power cord may be mounted. Another notch 62 in the heat shield 54 accommodates the metal raceway 20 when that mode of electrical connection is utilized.

The heat shield 54 (FIG. 3) is preferably removably attached to the metal cover 24 with the same bolt 64 and round nut 66 that hold the cover 24 to the metal backing plate 22 of the light fixture 10. The bolt 64 has a rear end secured to the backing plate 22 with a hex nut and a threaded forward section extending through aligned holes 48*b*, 24*c* and 54*d* in the bracket 48, cover 24 and heat shield 54, respectively, as indicated by the long phantom line in FIG. 3. The knurled nut 66 is screwed over the threaded forward section of the bolt 64 and tightened against the heat shield 54.

The metal backing plate 22 is formed with tongues 68, 70 and 72 (FIG. 3) at its opposite ends and on its side. Each has an upwardly convex or slightly curved shape and is slightly raised, i.e. spaced away from, but otherwise projects horizontally generally co-planar with a flat base 22*c* of the backing plate 22. The outer end of each tongue is tapered or beveled to facilitate insertion into the corresponding raceway segment. The vertical walls of the backing plate 22 are formed with cut-out regions 74, 76 and 78 through which the metal raceway 20 can extend for connection to one of the tongues 68, 70 and 72. During the fabrication of the metal backing plate 22 the cut-out regions 74, 76 and 78 are punched and the tongues 68, 70 and 72 are stamped. The backing plate 22 and tongues 68, 70, 72 are thus formed as one integral unit. The metal cover 24 includes breakaway portions such as 84 (FIG. 3), each of which is aligned with one of the tongues 68, 70, and 72, and the corresponding cut-out region 74, 76, and 78. Each breakaway portion is removable from the cover 24 to allow the metal raceway 20 to be inserted through the cover 24 into engagement with the corresponding tongue 68, 70, 72.

Figure 7A:
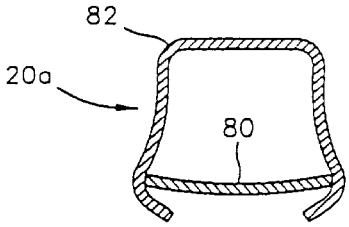
FIG. 7A is an enlarged cross-section of the metal raceway of FIG. 1.
Figure 7B:
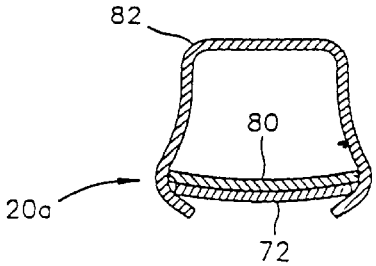
FIG. 7B is an enlarged cross-section of the metal raceway of FIG. 1 with the tongue of the metal backing plate of the light fixture housing inserted therein.

As shown in FIG. 7A the segment 20*a* of the metal raceway includes a curved base 80 and a cover section 82. Any one of the tongues, such as 72, may be snugly slid beneath the curved base 80, between the terminal side edges of the cover section 82 as illustrated in FIG. 7B. The side edges of the cover section 82 deflect outward slightly and squeeze tightly against the side edges of the tongue 72.

While I have described a preferred embodiment of my low profile under cabinet halogen light fixture that can be easily connected to a metal raceway, it will be understood by those skilled in the art that my invention may be modified in both arrangement and detail. For example both the light fixture housing and raceway could be made of non-metallic materials. The configuration and placement of the tongues could be varied. Therefore, the protection afforded my invention should only be limited in accordance with the scope of the following claims.

I claim:

1. A light fixture, comprising:

a housing including a backing plate and a cover removably secured to the backing plate;

at least one halogen lamp assembly mounted in an interior of the housing for providing light through a first aperture in the cover; and at least one tongue projecting from the backing plate generally parallel to and spaced upwardly from a flat base of the backing plate, whereby said tongue interfits with an open end of a raceway adapted for enclosing electrical conductors, said interfitting tongue and raceway thus providing enclosed conductor access into said fixture.

2. A light fixture according to claim 1 wherein the backing plate and tongue are formed as one integral unit.

3. A light fixture according to claim 2 wherein the backing plate and tongue are made of metal.

4. A light fixture according to claim 1 wherein the tongue has a convex shape.

5. A light fixture according to claim 1 wherein the tongue extends from one side of the backing plate.

6. A light fixture according to claim 5 and further comprising a second tongue and a third tongue extending from a pair of opposite ends of the backing plate.

7. A light fixture according to claim 1 wherein the backing plate is formed with a cut-out region for receiving the raceway.

8. A light fixture according to claim 1 wherein the tongue has a tapered outer end to facilitate insertion into the raceway.

9. A light fixture, comprising:

a housing including a backing plate and a cover removably secured to the backing plate, the cover being formed with a first aperture, the backing plate being formed with a cut-out region, the cover being formed with a removable breakaway portion aligned with the cut-out region of the backing plate for receiving a raceway adapted for enclosing electrical conductors;

at least one lamp assembly mounted in an interior of the housing for providing light through the first aperture in the cover; and at least one tongue projecting from the backing plate generally parallel to and spaced upwardly from a flat base of the backing plate, said tongue being structured to interfit with an open end of a raceway adapted for enclosing electrical conductors, whereby said interfitting tongue and raceway thus provide enclosed conductor access into said fixture.

* * * * *